US011603717B2

(12) United States Patent
Gessner et al.

(10) Patent No.: US 11,603,717 B2
(45) Date of Patent: Mar. 14, 2023

(54) INVERTED DIRECT DRIVE FEED SYSTEM

(71) Applicant: Laibe Corporation, Indianapolis, IN (US)

(72) Inventors: Stephen Gessner, Indianapolis, IN (US); Calvin Moore, Carmel, IN (US)

(73) Assignee: Laibe Corporation, Indianapolis, IN (US)

( * ) Notice: Subject to any disclaimer, the term of this patent is extended or adjusted under 35 U.S.C. 154(b) by 285 days.

(21) Appl. No.: 16/937,975

(22) Filed: Jul. 24, 2020

(65) Prior Publication Data

US 2021/0025250 A1 Jan. 28, 2021

Related U.S. Application Data

(60) Provisional application No. 62/878,898, filed on Jul. 26, 2019.

(51) Int. Cl.
*E21B 19/086* (2006.01)
*E21B 7/02* (2006.01)

(52) U.S. Cl.
CPC ..... *E21B 19/086* (2013.01); *E21B 7/02* (2013.01); *E21B 7/023* (2013.01)

(58) Field of Classification Search
CPC ..... E21B 19/086; E21B 7/02; E21B 7/023
See application file for complete search history.

(56) References Cited

U.S. PATENT DOCUMENTS

| | | | | |
|---|---|---|---|---|
| 3,447,652 | A * | 6/1969 | Tipton | E21B 7/023 175/321 |
| 3,814,194 | A * | 6/1974 | Reich | E21B 7/023 92/75 |
| 5,431,234 | A * | 7/1995 | Klemm | E21B 19/086 173/184 |
| 5,697,457 | A * | 12/1997 | Back | E21B 19/086 173/186 |
| 6,227,311 | B1 * | 5/2001 | Osadchuk | E21B 7/04 175/61 |
| 10,662,717 | B2 * | 5/2020 | Borra | E21B 7/023 |
| 2016/0258216 | A1 * | 9/2016 | Baaske | B60D 1/06 |
| 2020/0277828 | A1 * | 9/2020 | Daniels | E21B 7/02 |

* cited by examiner

*Primary Examiner* — Robert E Fuller
(74) *Attorney, Agent, or Firm* — Taft Stettinius & Hollister LLP

(57) ABSTRACT

An exemplary derrick assembly includes a frame, a hydraulic cylinder assembly, a drive assembly, and a hydraulic assembly. The hydraulic cylinder assembly is mounted to the frame, and includes a piston rod, a single-tube cylinder body, and a hydraulic chamber. The piston rod is secured to the frame, and the cylinder body is mounted to the piston rod for reciprocal movement between proximal and distal positions. The hydraulic chamber is defined in part by the piston rod and the cylinder body, and expands and contracts with movement of the cylinder body. The drive assembly is mounted to the cylinder body for movement with the cylinder body. The hydraulic assembly configured to charge hydraulic fluid into and out of the hydraulic chamber to cause the hydraulic chamber to expand and contract, thereby moving the cylinder body and the drive assembly between the proximal position and the distal position.

23 Claims, 12 Drawing Sheets

INVERTED DIRECT DRIVE FEED SYSTEM

CROSS-REFERENCE TO RELATED APPLICATIONS

The present application claims the benefit of U.S. Provisional Patent Application No. 62/878,898 filed Jul. 26, 2019, the contents of which are incorporated by reference in their entirety.

TECHNICAL FIELD

The present disclosure generally relates to the field of drilling, and more particularly but not exclusively relates to mobile drilling derricks.

BACKGROUND

Mobile drilling derricks are often mounted to vehicles (e.g., trucks and/or track drive vehicles) by which the derrick can be transported to a drilling site. However, it has been found that certain existing mobile derricks suffer from a variety of drawbacks and limitations, including those related to excessive weight and maintenance requirements. For these reasons among others, there remains a need for further improvements in this technological field.

SUMMARY

An exemplary derrick assembly includes a frame, a hydraulic cylinder assembly, a drive assembly, and a hydraulic assembly. The hydraulic cylinder assembly is mounted to the frame, and includes a piston rod, a single-tube cylinder body, and a hydraulic chamber. The piston rod is secured to the frame, and the cylinder body is mounted to the piston rod for reciprocal movement between a proximal position and a distal position. The hydraulic chamber is defined in part by the piston rod and the cylinder body, and expands and contracts with movement of the cylinder body. The drive assembly is mounted to the cylinder body for movement with the cylinder body. The hydraulic assembly is configured to charge hydraulic fluid into and out of the hydraulic chamber to cause the hydraulic chamber to expand and contract, thereby moving the cylinder body and the drive assembly between the proximal position and the distal position. Further embodiments, forms, features, and aspects of the present application shall become apparent from the description and figures provided herewith.

DETAILED DESCRIPTION OF ILLUSTRATIVE EMBODIMENTS

Figure 1:
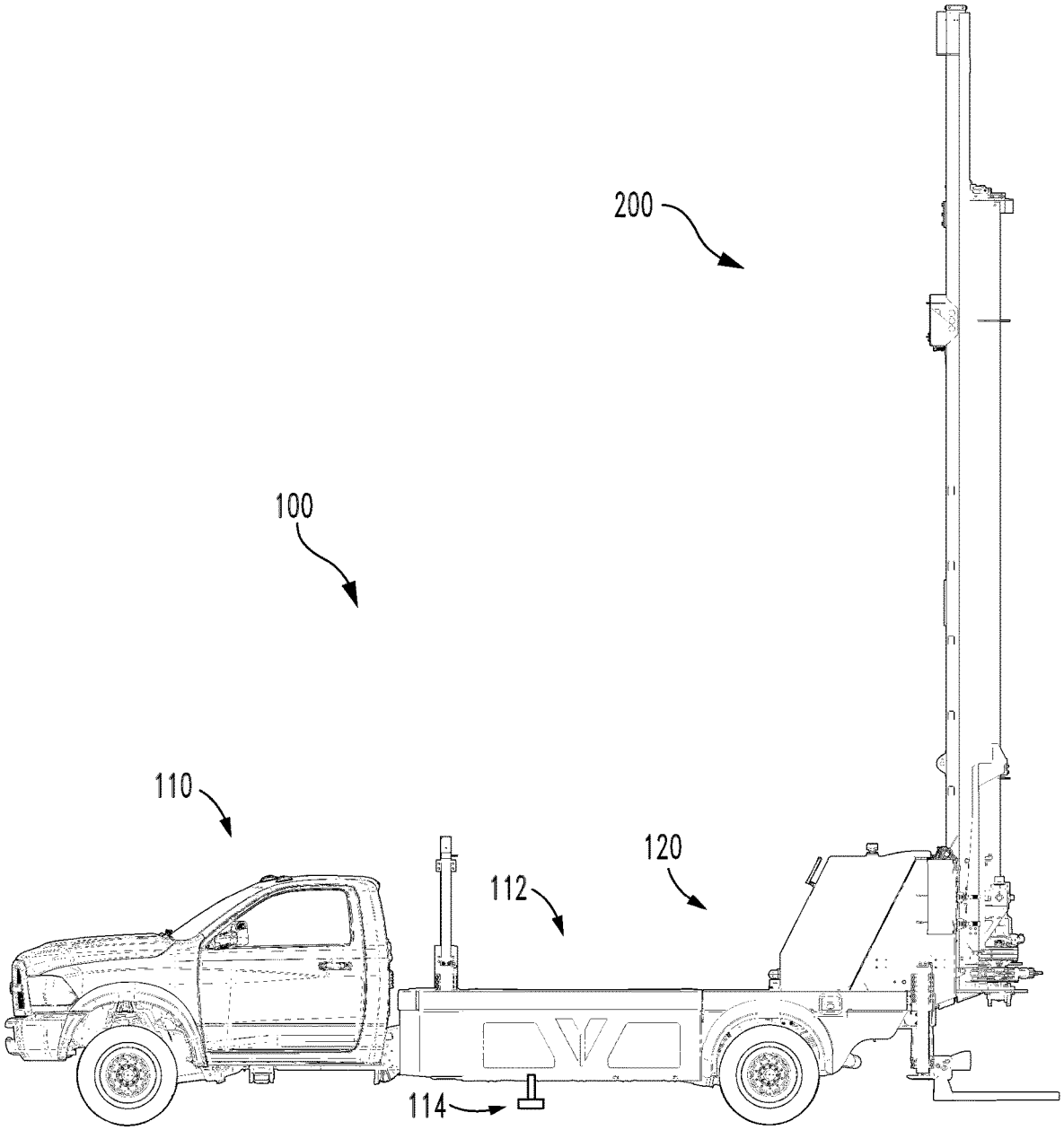
FIG. 1 is a schematic representation of a mobile drilling rig according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

With reference to FIG. 1, illustrated therein is a mobile drilling rig 100 according to certain embodiments. The mobile drilling rig 100 generally includes a vehicle 110 having mounted thereon a lifting assembly 120 and a derrick assembly 200 according to certain embodiments. In the illustrated form, the vehicle 110 is a standard consumer-grade flatbed truck that does not require a commercial driver's license (CDL) to operate. As will be appreciated, such consumer-grade trucks typically have a lower hauling capacity than commercial-grade trucks, such as tractor-trailers. While certain conventional mobile drilling rigs utilize commercial-grade trucks, certain aspects of the present disclosure may provide for a lower-weight derrick assembly 200 that is capable of being installed to consumer-grade trucks without exceeding the hauling capacity of the vehicle 110. It is also contemplated, however, that the derrick assembly 200 may be utilized in connection with (e.g., installed to) vehicles of other types, including commercial-grade vehicles and track vehicles to be used in off-road applications.

The vehicle 110 includes a drill deck 112 on which the lifting assembly 120 and the derrick assembly 200 are mounted. The vehicle 110 may further include selectively deployable support jacks 114 that engage the ground to provide support during deployment of the derrick assembly 200. The lifting assembly 120 is configured to move the derrick assembly 200 between a first, substantially horizontal orientation for transport and a second, substantially vertical orientation for use. Additionally or alternatively, the lifting assembly 120 may be operable to position the derrick assembly 200 at an oblique orientation relative to the ground. The lifting assembly 120 may take any form known in the art, such as mechanical, hydraulic, or the like. As noted above, the illustrated vehicle 110 is provided in the form of a flatbed truck. It is also contemplated, however, that the vehicle 110 may be provided in another form, such as that of a tracked vehicle.

Figure 2:
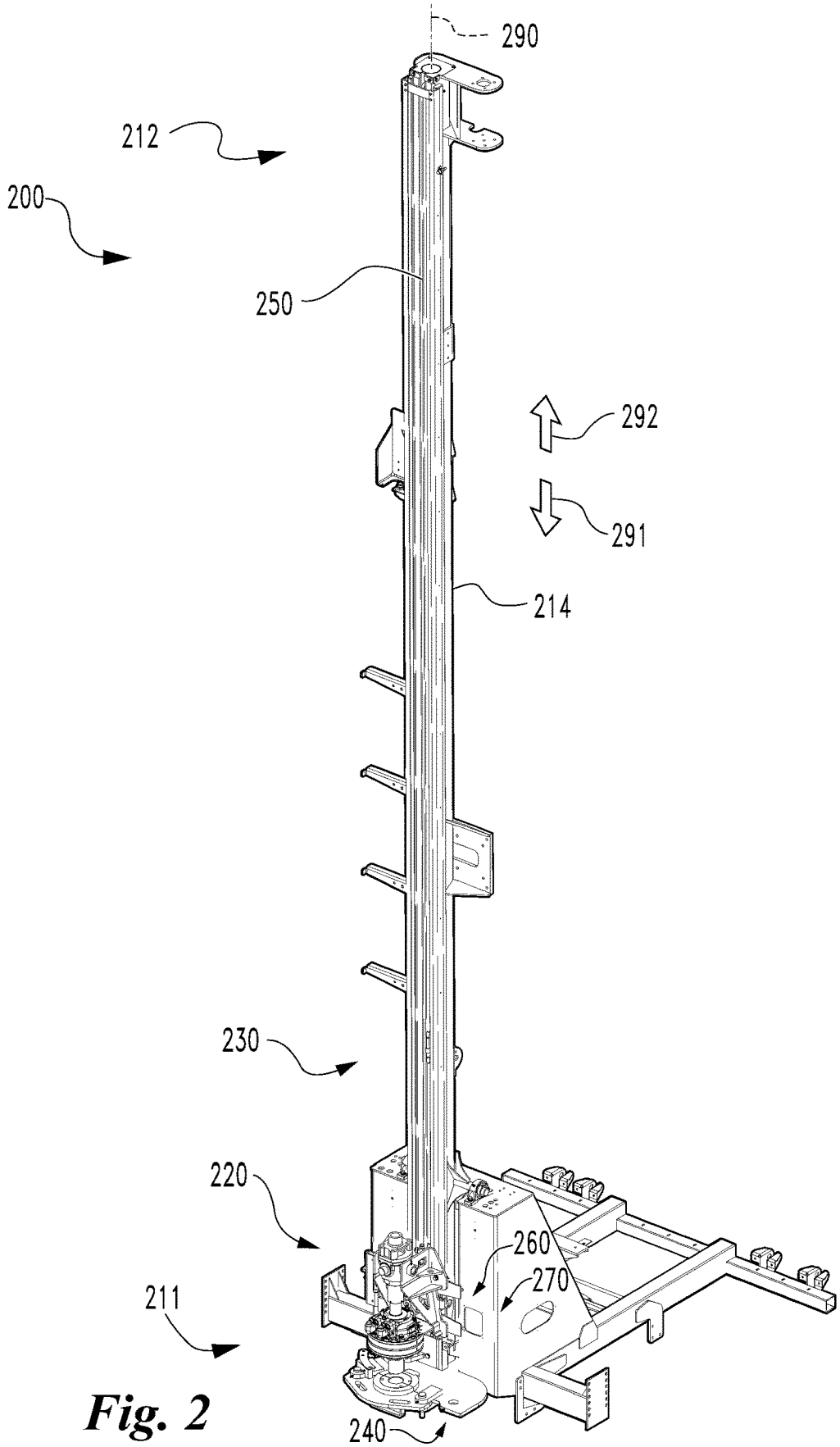
FIG. 2 is a perspective view of a derrick assembly according to certain embodiments.

With additional reference to FIG. 2, the derrick assembly 200 generally includes a frame 210, a drive assembly 220 operable to rotate a drill string including a drill bit, and a hydraulic cylinder assembly 230 to which the drive assembly 220 is mounted. The derrick assembly 200 is configured to drill holes in the ground for varying reasons including but not limited to water wells, oil and gas wells, environmental exploration, geothermal technology, and/or cathodic protection. As described in further detail below, the illustrated hydraulic cylinder assembly 230 generally includes a static component in the form of a piston rod 240, a movable component in the form of a cylinder body 250 that is mounted to the piston rod 240, a mounting assembly 260 by which the drive assembly 220 is mounted to the cylinder body 250, and a hydraulic assembly 270 operable to move the cylinder body 250 between a proximal position and a distal position.

The frame 210 extends primarily along a longitudinal axis 290 defining a proximal direction 291 and an opposite distal direction 292. When in use, the frame 210 may be oriented such that the longitudinal axis 290 extends vertically. In such forms, the proximal direction 291 may be a generally downward direction, and the distal direction 292 may be a generally upward direction. As such, the proximal direction 291 may occasionally be referred to herein as the downward direction, and the distal direction 292 may occasionally be referred to herein as the upward direction. It is to be understood, however, that the derrick assembly 200 is capable of being placed in other orientations. For example, when in transit, the derrick assembly 200 may be substantially horizontal such that the proximal and distal directions 291, 292 are substantially horizontal directions. Moreover, the derrick assembly 200 may be utilized in an oblique orientation in which the proximal and distal directions are oblique relative to the vertical direction. As such, the terms "proximal" and "distal" should not be construed as being limited to purely vertical directions.

Figure 3:
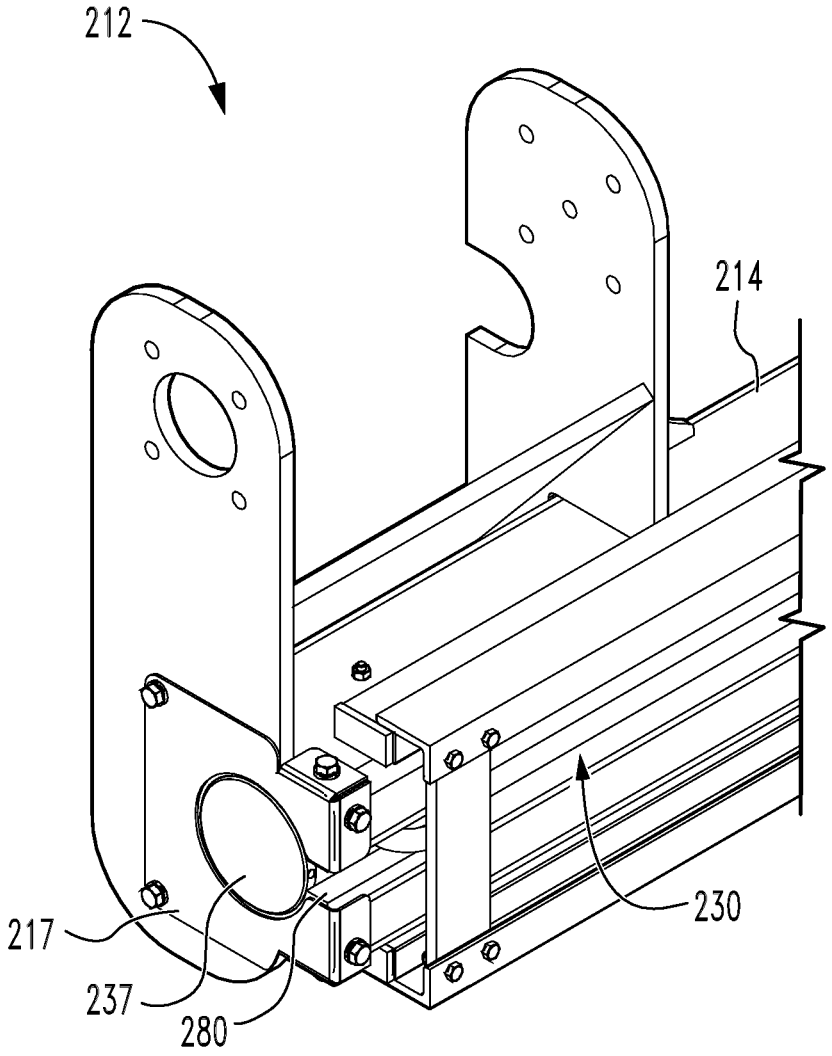
FIG. 3 is a perspective view of a distal end portion of the derrick assembly.
Figure 4:
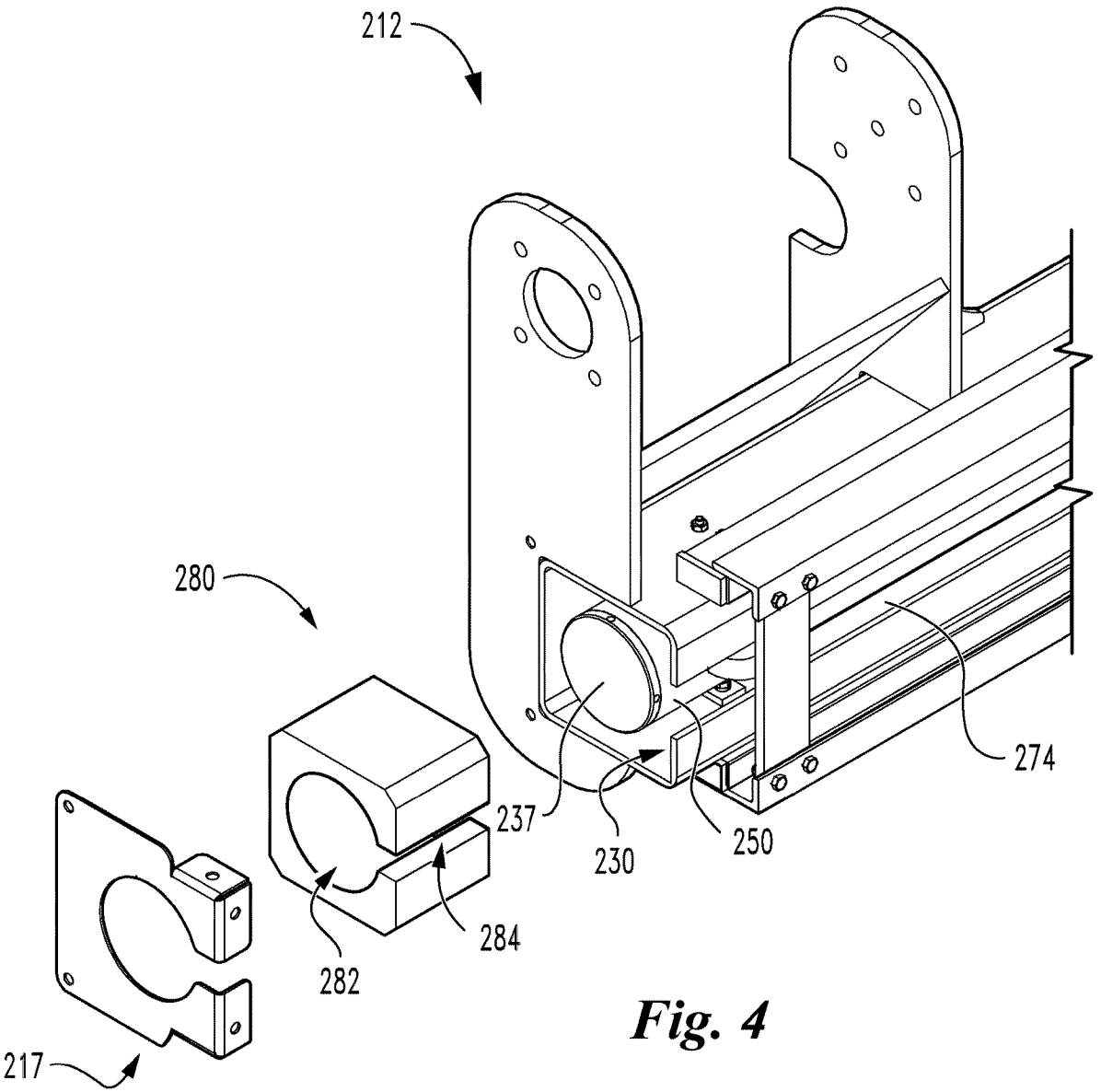
FIG. 4 is a partially-exploded view of the distal end portion of the derrick assembly

With additional reference to FIGS. 3 and 4, the frame 210 provides a relatively static structure on which the drive assembly 220 and a movable part of the hydraulic cylinder assembly 230 reciprocate between a proximal position and a distal position. The frame 210 has a proximal end portion 211 and a distal end portion 212, and includes a channel 214 that extends between the proximal end portion 211 and the distal end portion 212. Mounted within the distal end portion 212 of the channel 214 is a slide block 280 that, as described in further detail below, facilitates the reciprocal movement of the hydraulic cylinder assembly 230 relative to the frame 210. The frame 210 also includes a housing 216 having mounted therein a hydraulic pump system 278 of the hydraulic assembly 270. The illustrated frame 210 further includes a drill table 218 defining a guide hole 219 that, as described herein, is used to guide a drill rod of a drill string that is being drilled into the ground.

Figure 5:
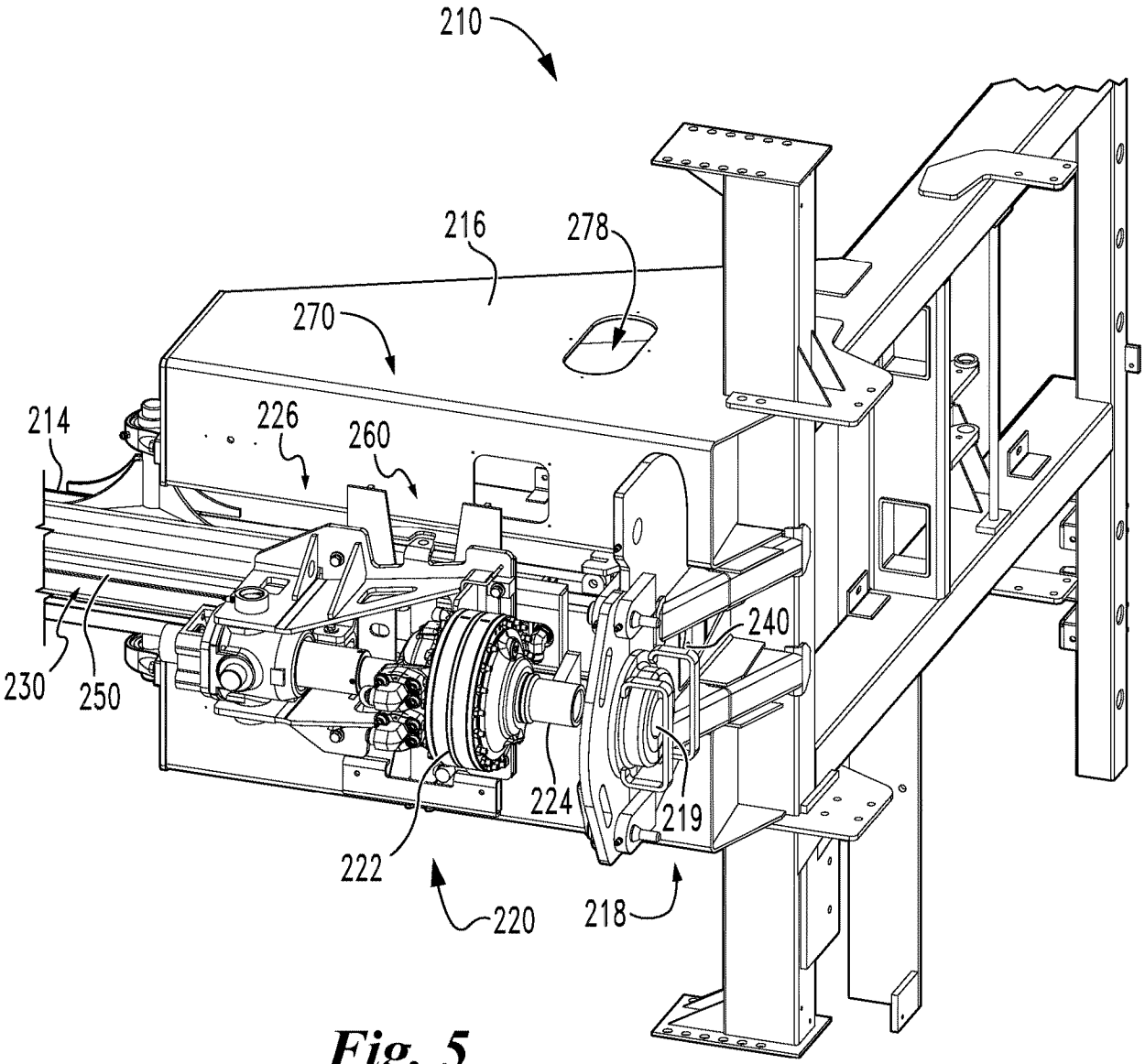
FIG. 5 is a perspective view of a portion of the derrick assembly, including a drive assembly.
Figure 6:
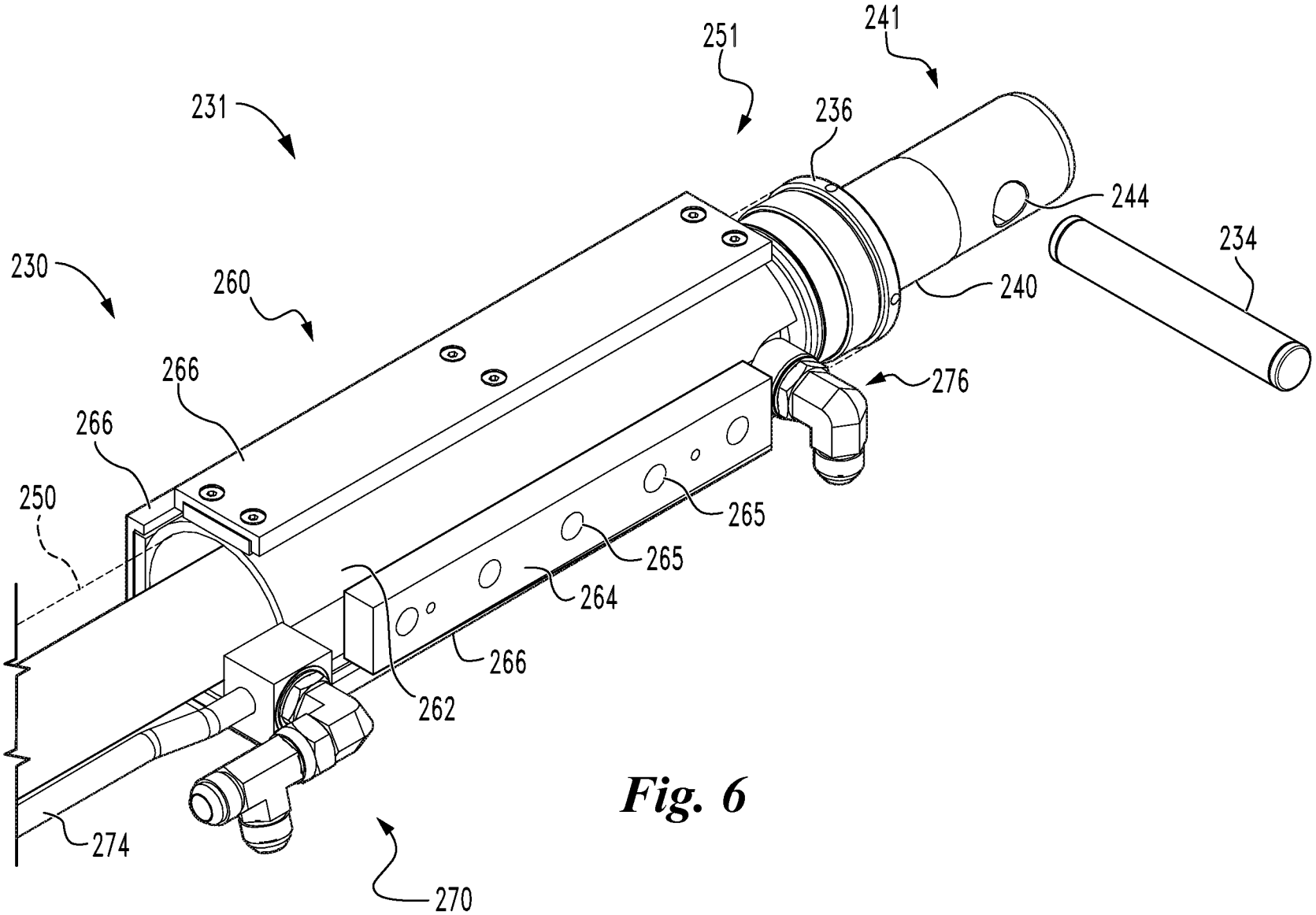
FIG. 6 is a perspective view of a proximal end portion of a hydraulic cylinder assembly according to certain embodiments.
Figure 7:
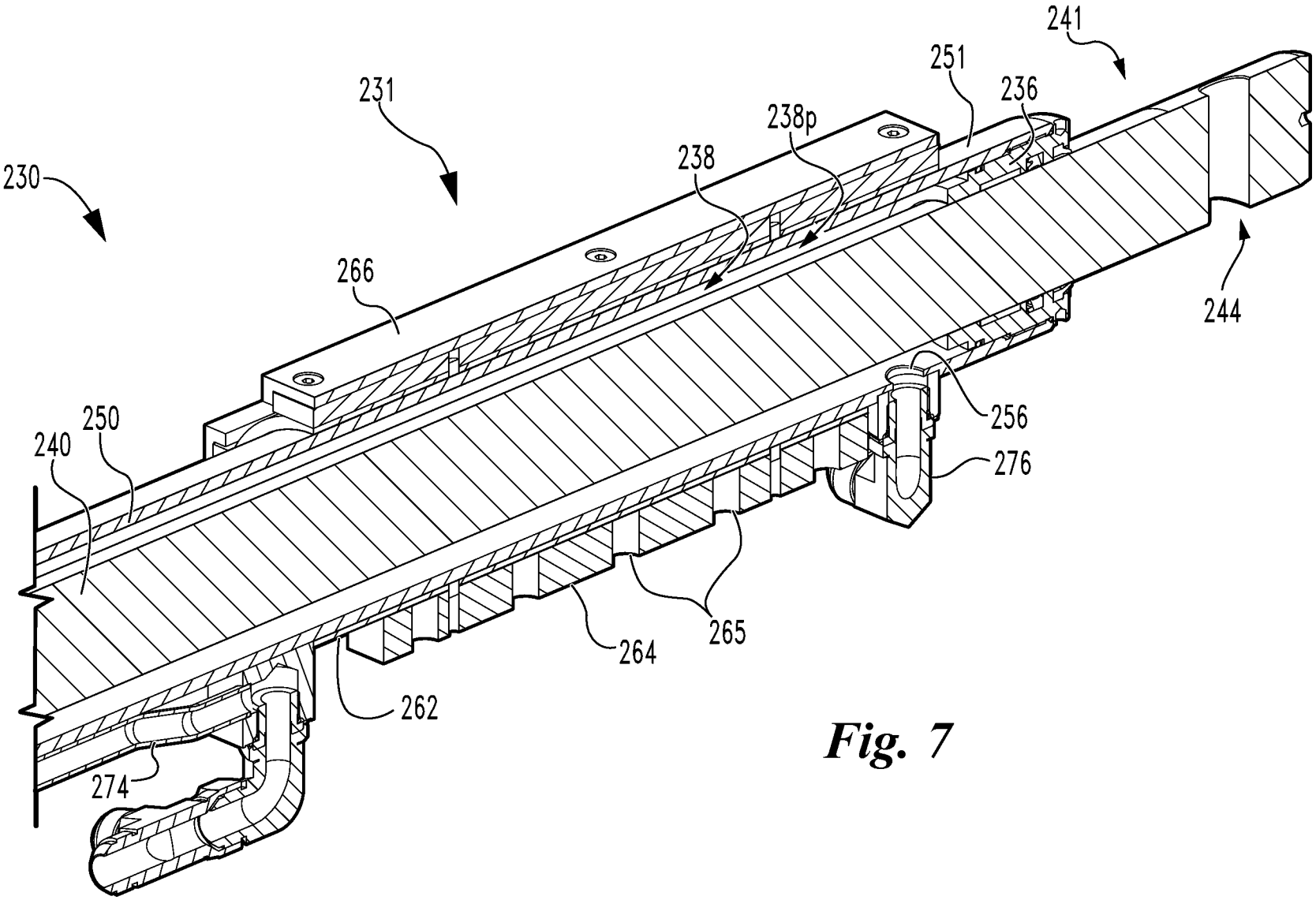
FIG. 7 is a cutaway view of the proximal end portion of the hydraulic cylinder assembly.

With additional reference to FIG. 5, the illustrated drive assembly 220 generally includes a motor 222 having an output shaft 224 that is rotated by the motor 222, and a drive assembly frame 226 to which the motor 222 is mounted. The output shaft 224 is configured for coupling with a drill bit and/or a drill string including such a drill bit such that the motor 222 is operable to rotate the bit. The output shaft 224 may be coupled with the bit via one or more drill rods that transmit rotation of the output shaft 224 to the bit, thereby extending the depth to which the derrick assembly 200 is operable to drill. The output shaft 224 is aligned with the guide hole 219 such that the drill rod is operable to extend through the guide hole 219 while being rotated by the motor 222.

Figure 8:
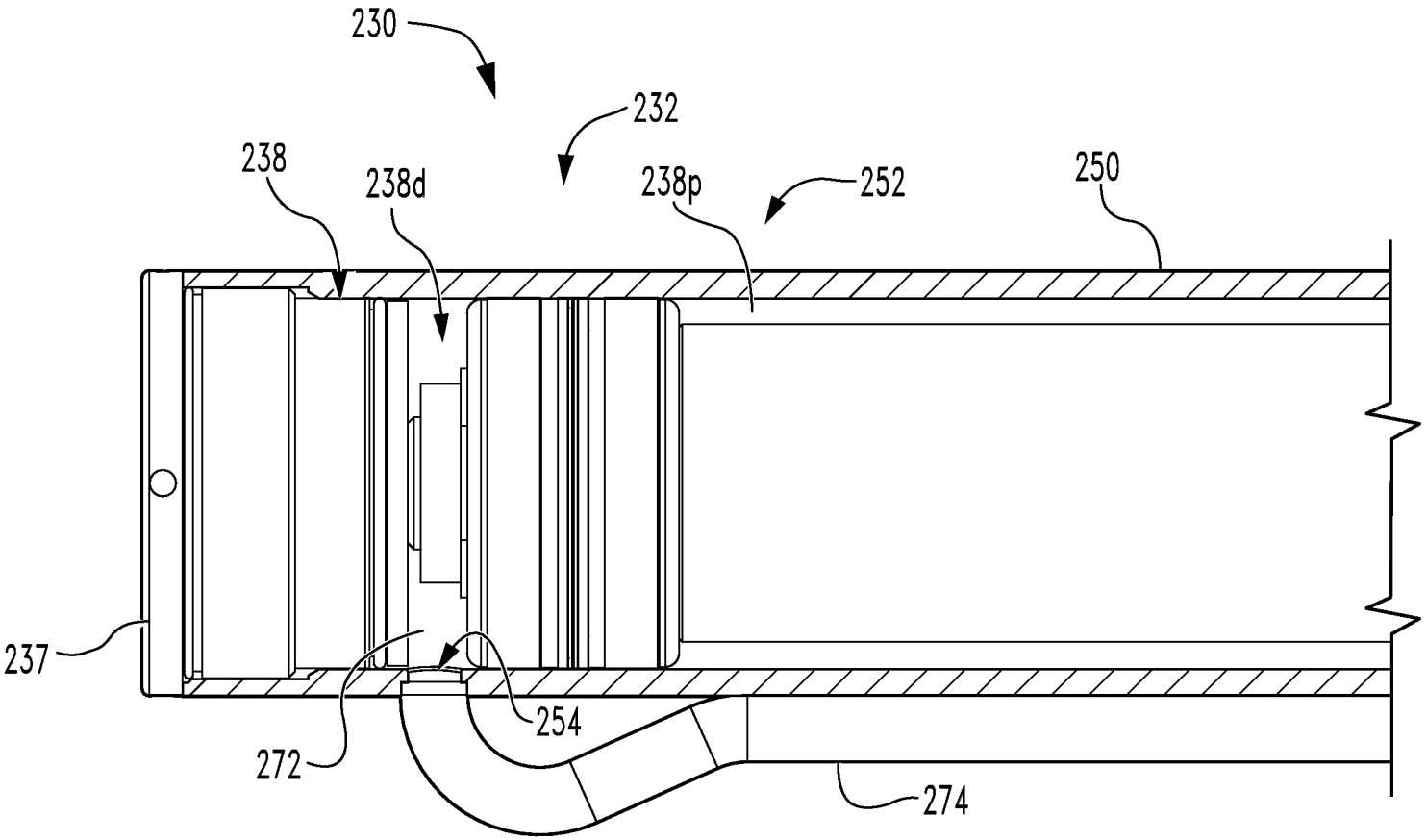
FIG. 8 is a plan view of a distal end portion of the hydraulic cylinder assembly.
Figure 9:
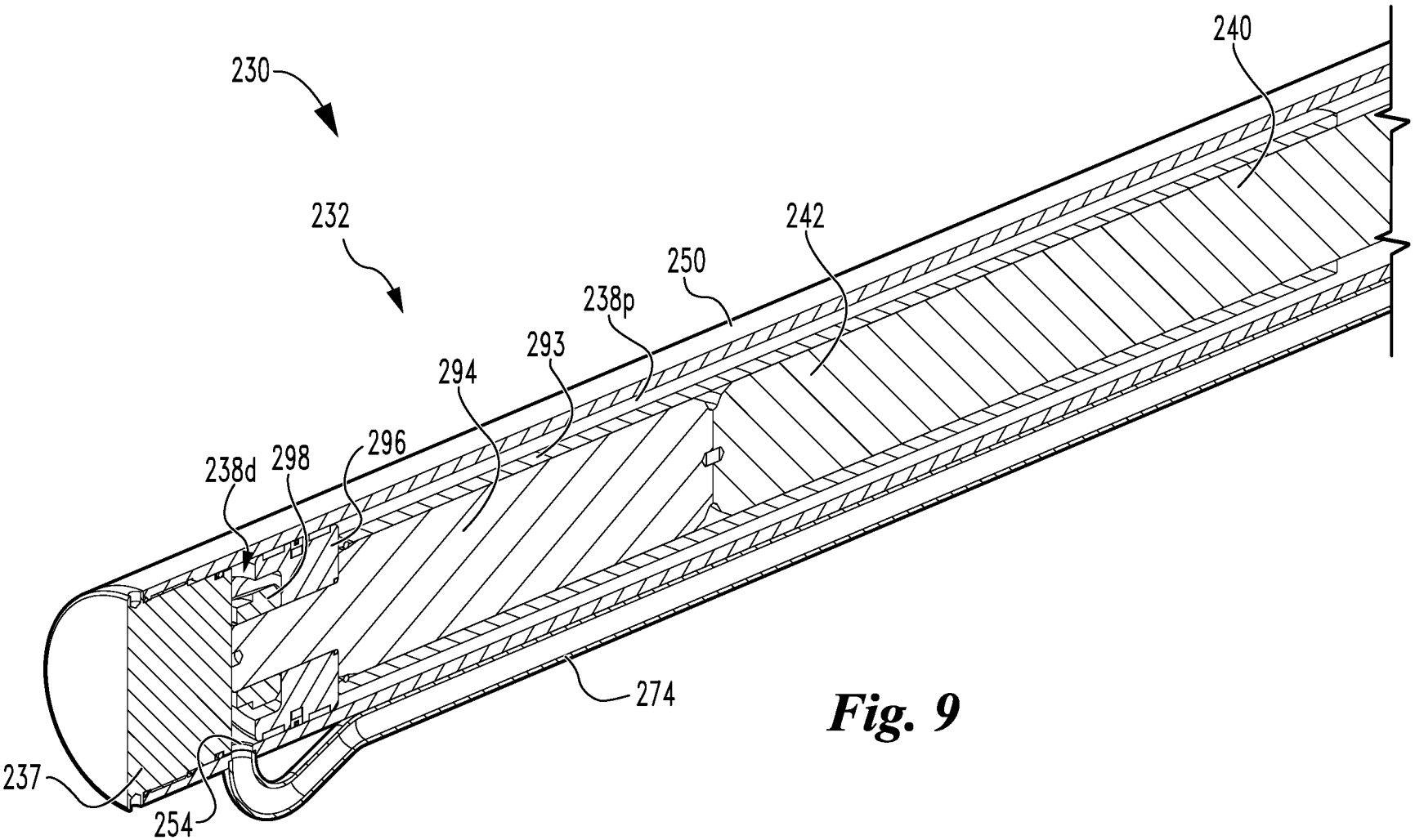
FIG. 9 is a cutaway view of the distal end portion of the hydraulic cylinder assembly.
Figure 11:
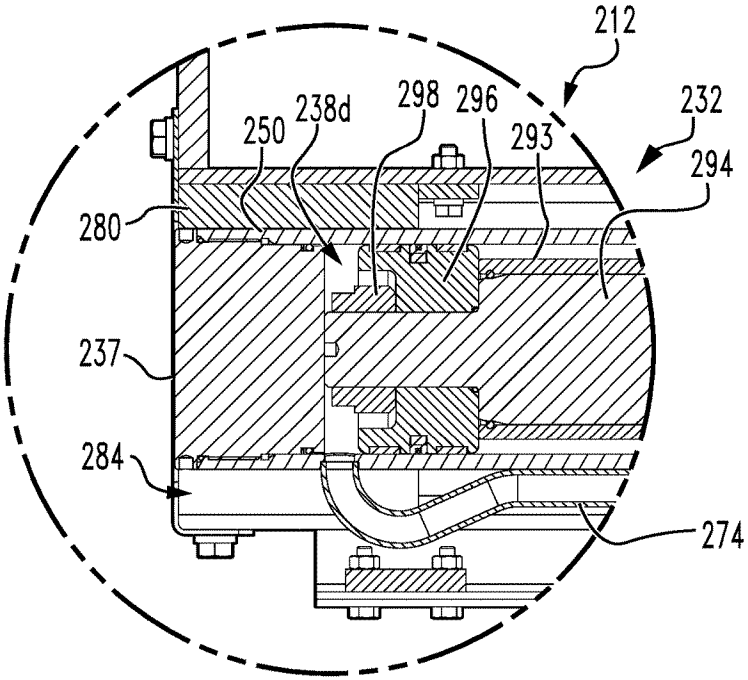
FIG. 11 is a magnified view of the inset XI illustrated in FIG. 10.
Figure 12:
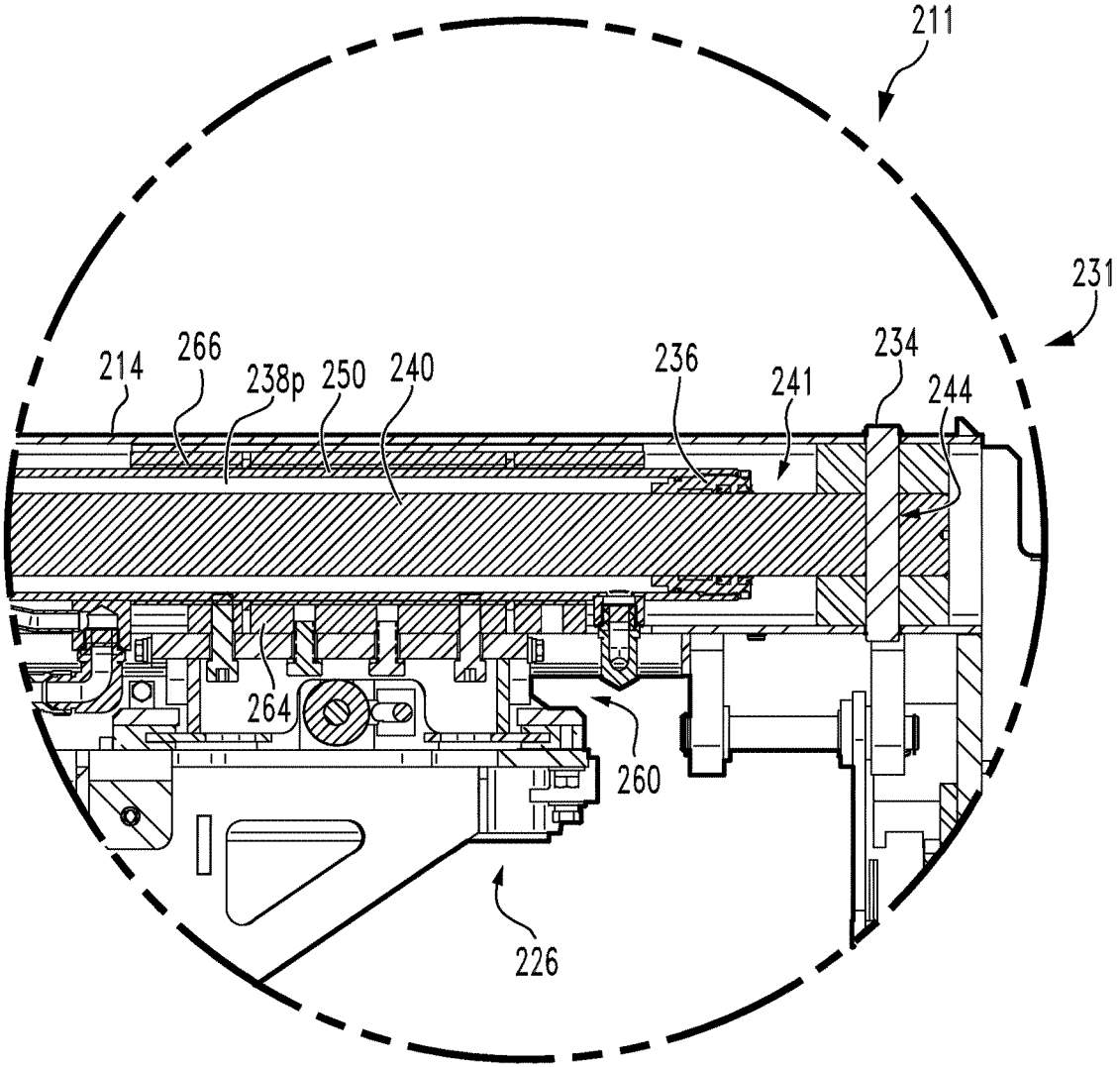
FIG. 12 is a magnified view of the inset XII illustrated in FIG. 10.

With additional reference to FIGS. 6-9, 11 and 12, the hydraulic cylinder assembly 230 has a proximal end portion 231 (FIGS. 6, 7 and 12) and a distal end portion 232 (FIGS. 8, 9, and 11). The hydraulic cylinder assembly 230 generally includes a piston rod 240, a single-tube cylinder body 250 movably mounted to the piston rod 240 for reciprocal movement between a proximal position and a distal position, a mounting assembly 260 secured to a proximal end portion 251 of the cylinder body 250, and a hydraulic assembly 270 operable to move the hydraulic cylinder assembly 230 between a home or contracted state and an expanded or extended state. The hydraulic cylinder assembly 230 defines a hydraulic chamber 238 including a proximal sub-chamber **238*p* and a distal sub-chamber 238*d*, which expand and contract as the hydraulic assembly 270 charges a hydraulic fluid into and out of the chambers 238*p*, 238*d*. As described herein, this expansion and contraction of the sub-chambers 238*p*, 238*d* by the hydraulic assembly 270 moves the hydraulic cylinder assembly 230 between its expanded and contracted states, thereby moving the cylinder body 250** between its proximal and distal positions.

The piston rod 240 includes a proximal end portion 241 that defines an opening 244 through which a pin 234 passes to secure the piston rod 240 to the frame 210 such that the piston rod 240 remains substantially static relative to the frame 210. The proximal end portion 241 of the piston rod 240 passes through a proximal end cap 236 that is mounted to the proximal end of the cylinder body 250 and defines a hydraulic seal between the piston rod 240 and the cylinder body 250, thereby sealing the proximal end of the hydraulic chamber 238. A distal end portion 242 of the piston rod 240 is received in a collar 293 and abuts a distal rod 294, which is secured to an internal seal cap 296, for example by a nut 298. The internal seal cap 296 divides the hydraulic chamber 238 into the proximal sub-chamber 238*p* and the distal sub-chamber 238*d*. In certain embodiments, the distal rod 294 may be secured to the piston rod 240, and may be considered to constitute a portion of the piston rod 240.

The cylinder body 250 has a proximal end portion 251 to which the mounting assembly 260 is secured, and an opposite distal end portion 252. The distal end portion 252 has mounted thereon a distal end cap 237, which seals the distal end of the hydraulic chamber 238. Positioned between the distal end cap 237 and the internal seal cap 296 is a distal aperture 254 that connects the distal sub-chamber 238*d* with the hydraulic assembly 270. Similarly, a proximal aperture 256 is formed in the proximal end portion 251 of the cylinder body 250, and connects the proximal sub-chamber 238*p* with the hydraulic assembly 270.

The mounting assembly 260 is mounted to the proximal end portion 251 of the cylinder body 250, and provides a mounting location for the drive assembly 220. The mounting assembly 260 includes a collar 262 secured to the outer side of the cylinder body 250, and a mounting plate 264 secured to the collar 262. The mounting assembly 260 may further include one or more guide plates 266 that interface with the channel 214 to guide the cylinder body 250 between its proximal and distal positions during expansion and contraction of the cylinder assembly 230. The mounting plate 264 includes one or more apertures 265 that receive bolts by which the drive assembly frame 226 is secured to the mounting assembly 260. As such, the drive assembly 220 is secured to the cylinder body 250 for movement with the cylinder body 250 between its proximal and distal positions.

The hydraulic assembly 270 is configured to charge a hydraulic fluid 272 into and out of the hydraulic chamber 238 to cause the sub-chambers 238*d*, 238*p* to expand and contract. The hydraulic assembly 270 includes an expansion line 274, a contraction line 276, and a pump system 278 that charges the hydraulic fluid 272 into and out of the chamber 238 via the lines 274, 276. The expansion line 274 is open to the distal sub-chamber 238*d* via the distal aperture 254, and the contraction line 276 is open to the proximal sub-chamber 238*p* via the proximal aperture 256.

The hydraulic assembly 270 is operable to move the cylinder body 250 between its proximal and distal positions by selectively charging fluid 272 into and discharging fluid 272 from the proximal and distal sub-chambers 238*p*, 238*d*. Movement of the cylinder body 250 in the proximal direction is associated with expansion of the proximal sub-chamber 238*p* and contraction of the distal sub-chamber 238*d*. Accordingly, the hydraulic assembly 270 may move the cylinder body 250 toward its proximal position by charging fluid 272 into the proximal sub-chamber 238*p* via the contraction line 276 and discharging fluid 272 from the distal sub-chamber 238*d* via the expansion line 274. Conversely, movement of the cylinder body 250 in the distal direction is associated with expansion of the distal sub-chamber 238*d* and contraction of the proximal sub-chamber 238*p*. Accordingly, the hydraulic assembly 270 may move the cylinder body 250 toward its distal position by charging fluid 272 into the distal sub-chamber 238*d* via the expansion line 274 and discharging fluid 272 from the proximal sub-chamber 238*p* via the contraction line 276.

The slide block 280 is mounted to the frame 210 within the distal end portion of the channel 214. The slide block 280 includes a central opening 282 that receives the cylinder body 250, and a slot 284 sized and shaped to receive the expansion line 274. The slide block 280 aids in the reciprocation of the cylinder body 250 by providing a guide surface along which the cylinder body 250 slides as the cylinder body 250 reciprocates between its proximal and distal positions. The slide block 280 also provides lateral support to the cylinder body 250 and aids in discouraging long-column buckling that may otherwise occur. The slide block 280 may be formed of a low-friction and high-durability material. In certain forms, the slide block 280 may be formed of an ultra-high molecular weight (UHMW) plastic material, such as UHMW polyethylene.

Figure 10:
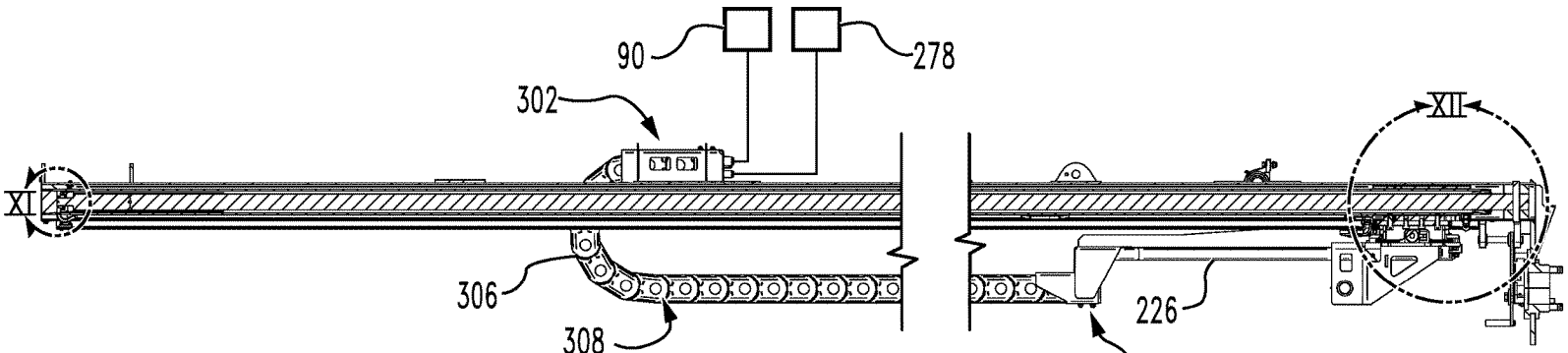
FIG. 10 is a longitudinal cross-sectional view of a portion of the derrick assembly, and includes insets XI and XII.

With additional reference to FIG. 10, the derrick assembly 200 further includes a flexible connection assembly 300 including a fixed end 302 mounted to the channel 214, a movable end 304 mounted to the drive assembly frame 226, an articulating flexible linkage 306 extending between the fixed and movable ends 302, 304, and a plurality of lines 308 supported by the flexible linkage 306. Each of the lines 308 has a fixed end connector disposed at the fixed end 302 and a movable end connector disposed at the movable end 304. Via the fixed end connectors, the lines 308 can be connected to a source operable to provide the commodity that flows through the lines 308. For example, the lines 308 may include a power line and one or more hydraulic lines. The power line may be operable to connect a power source 90 with the motor 222 such that the motor 222 is operable to draw electrical power from the power source 90. The power source 90 may be the vehicle generator or a battery used to drive control functions on the derrick assembly 200 such as switches and lights. The hydraulic lines may be operable to connect the hydraulic pump system 278 to the expansion and contraction lines 274, 276 such that the hydraulic pump system 278 is operable to charge fluid 272 into and out of the sub-chambers 238*d*, 238*p* as needed to move the hydraulic cylinder assembly 230 between its expanded and contracted states.

Figure 13:
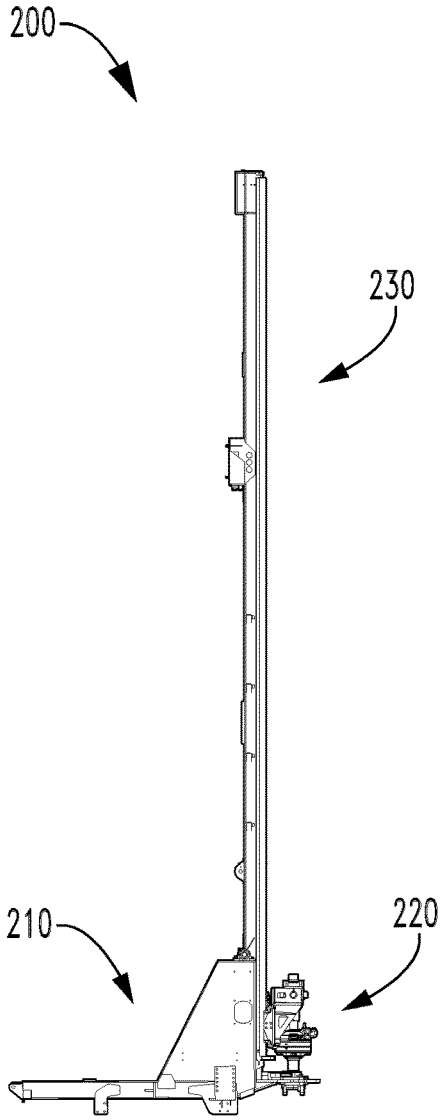
FIG. 13 is an elevational view of the derrick assembly in a home state.
Figure 14:
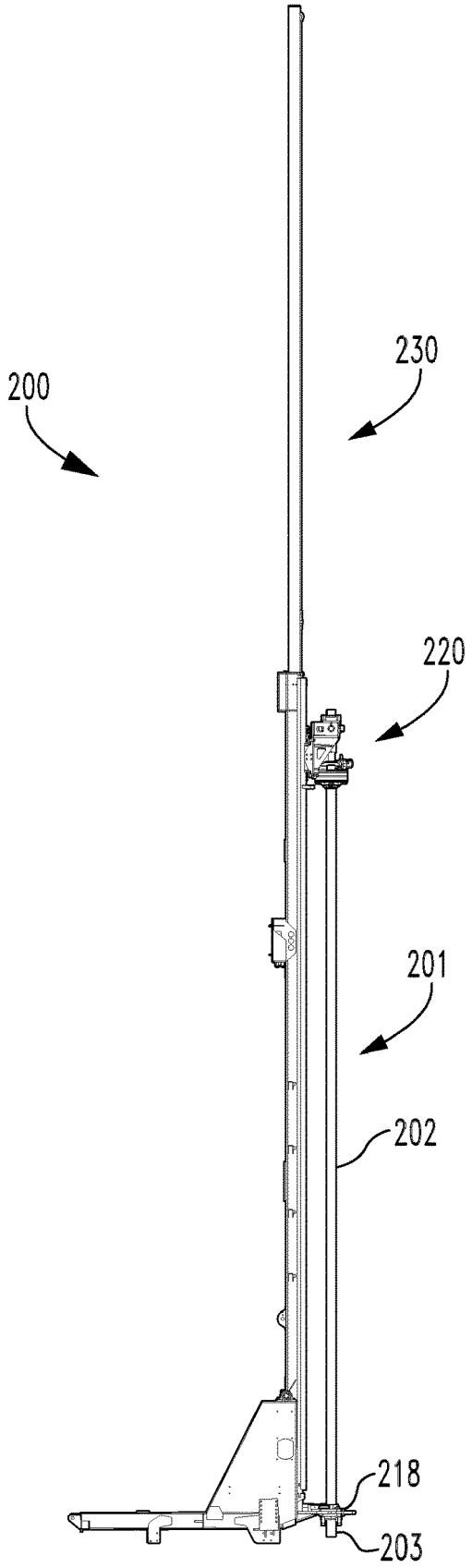
FIG. 14 is an elevational view of the derrick assembly in an expanded state.

With additional reference to FIGS. 13 and 14, a drilling operation involving the mobile drilling rig 100 may proceed along the following lines. The drilling rig 100 is first moved to the location where a well is to be formed, and the lifting assembly 120 is operated to place the derrick assembly 200 in a vertical orientation. At this point, the derrick assembly 200 may be in its home or contracted state, in which the cylinder body 250 and the drive assembly 220 are in the proximal or lower positions thereof. The hydraulic assembly 270 may then be operated to drive the drive assembly 220 from its proximal or lower position (FIG. 13) to its distal or upper position (FIG. 14).

In order to operate the drive assembly 220 to its upper position, the hydraulic assembly 270 is operated to charge hydraulic fluid 272 into the distal sub-chamber 238*d* via the expansion line 274. As the hydraulic fluid 272 is charged into the chamber 238, the fluid 272 exerts opposing forces on the distal end cap 237 and the internal seal cap 296. Due to the fact that the internal seal cap 296 is prevented from moving downward by the piston rod 240, these forces result in distal or upward movement of the cylinder body 250 and the drive assembly 220 attached thereto, thereby moving the hydraulic cylinder assembly 230 to its expanded state. As a result of expansion of the distal sub-chamber 238*d*, the proximal sub-chamber 238*p* contracts. Accordingly, moving the drive assembly 220 to its upper position may involve charging hydraulic fluid 272 into the distal sub-chamber 238*d* while discharging hydraulic fluid 272 from the proximal sub-chamber 238*p*.

Once the drive assembly 220 reaches its upper position, the drive assembly 220 is loaded with a drill string 201 including a drill rod 202 having a drilling bit 203 mounted to the lower end thereof. The motor 222 is then operated to rotate the drill rod 202, causing the bit 203 to drill into the ground while the guide hole 219 provides radial support that maintains the radial or lateral position of the drill rod 202. As the bit 203 advances, the hydraulic assembly 270 is operated to charge fluid 272 into the expanding proximal sub-chamber 238*p* and permitting hydraulic fluid 272 to flow out of the contracting distal sub-chamber 238*d*, thereby allowing the hydraulic cylinder assembly 230 to contract as the drive assembly 220 and cylinder body 250 lower. When the drive assembly 220 reaches its lower position, the drill rod 202 is decoupled from the output shaft 224, and the drive assembly 220 is again raised to its upper position. An additional drill rod 202 is then coupled with the output shaft 224 and the initial drill rod 202 such that the motor 222 is operable to rotate the bit 203 by rotating the drill string 201, which now includes the coupled drill rods 202. The process may then be repeated as warranted to reach a desired drill depth.

Once the desired drill depth is reached, the above-described process may be essentially reversed to withdraw the drill string 201 from the bore drilled by the bit 203. In order to do so, the drive assembly 220 having the drill string 201 coupled thereto is raised from its lower position to its upper position, thereby withdrawing the drill string 201 from the bore by the length of one drill rod 202. The now-exposed drill rod 202 is decoupled from the output shaft 224 and the remainder of the drill string 201 while a clamp retains the now-decoupled drill string 201 from falling back into the bore. In certain embodiments, the drill rods 202 may be managed using an automated rod handling system such as that disclosed in U.S. Pat. No. 8,240,968 to Hopkins et al., the contents of which are hereby incorporated by reference in their entirety.

As should be evident from the foregoing, the hydraulic cylinder assembly 230 includes a fixed component in the form of a piston rod 240 that is fixed to the frame 210 and a movable component in the form of a cylinder body 250 that is movably mounted to the fixed part (in the illustrated form, the piston rod 240). It is also contemplated that this arrangement may be reversed such that the cylinder body 250 is provided as the fixed component and the rod 240 is provided as the movable component. However, it has unexpectedly been found that the illustrated arrangement provides for certain advantages relative to the alternative arrangement, such as those relating to the amount of pull-out force the hydraulic cylinder assembly 230 is operable to generate given a fixed capacity of the hydraulic pump system 278.

It should also be noted that certain existing systems include piston assemblies in which multiple concentric cylinder bodies are utilized. In contrast to these systems, the illustrated embodiment utilizes a single-cylinder body design in which the cylinder body 250 to which the mounting assembly 260 is mounted is movably mounted to the piston rod 240 without an intermediate cylinder body being positioned therebetween. It has been found that this elimination of the intermediate cylinder body represents a significant weight savings that aids in reducing the overall weight of the derrick assembly 200 to a weight suitable for mounting to consumer-grade vehicles 110. As such, the operator of the drilling assembly 100 need not have a CDL, and may instead have only a standard-issue driver's license. Eliminating the need for a CDL may facilitate the operation of the drilling rig 100 and/or reduce the operational costs of the drilling assembly 100, particularly in regions where operators with CDL certification have come into high demand.

Another potential advantage of the subject matter disclosed herein relates to the slide block 280. As noted above, the slide block 280 may aid in reducing long-column buckling and guiding movement of the cylinder body 250 between its proximal and distal positions. It may be the case that with use of the derrick assembly 200, the slide block 280 may wear and the diameter of the opening 282 may increase to a size unsuitable for performing its primary functions. In such a case, the slide block 280 can easily and inexpensively be removed and replaced during routine maintenance.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A derrick assembly, comprising:

a frame;

a hydraulic cylinder assembly mounted to the frame, the hydraulic cylinder assembly comprising:

a piston rod secured to the frame;

a single-tube cylinder body mounted to the piston rod for reciprocal movement between a proximal position and a distal position; and a hydraulic chamber defined at least in part by the piston rod and the single-tube cylinder body, the hydraulic chamber having disposed therein a hydraulic fluid, the hydraulic chamber expanding and contracting with movement of the cylinder body between the proximal position and the distal position;

wherein the hydraulic cylinder assembly is a single-stage hydraulic cylinder assembly, and wherein a distal end portion of the single-tube cylinder body includes a hydraulic port in fluid communication with the single-stage hydraulic cylinder assembly;

a drive assembly mounted to the cylinder body for movement with the cylinder body between the proximal position and the distal position, wherein the drive assembly is operable to rotate an output shaft; and a hydraulic assembly configured to charge the hydraulic fluid into and out of the hydraulic chamber to cause the hydraulic chamber to expand and contract, thereby moving the cylinder body and the drive assembly between the proximal position and the distal position.

2. The derrick assembly of claim 1, further comprising a mounting assembly secured to the cylinder body, the mounting assembly comprising a collar and a mounting plate secured to the collar, wherein the drive assembly is secured to the mounting plate.

3. The derrick assembly of claim 2, wherein the frame comprises an elongated channel;

wherein the mounting assembly further comprises a guide plate secured to the collar; and wherein the guide plate interfaces with the channel to guide the cylinder body between the proximal position and the distal position.

4. The derrick assembly of claim 3, further comprising a flexible connection assembly, the flexible connection assembly comprising:

a fixed end secured to the channel;

a movable end secured to the mounting assembly;

a flexible linkage extending between the fixed end and the second end; and a plurality of lines supported by the flexible linkage, the plurality of lines operable to connect the drive assembly to a power source and to connect the hydraulic assembly to a hydraulic pump.

5. The derrick assembly of claim 1, wherein the frame comprises an elongated channel in which the cylinder body is reciprocably mounted for movement between the proximal position and the distal position; and wherein the channel has mounted therein a slide block along which the cylinder body slides as the cylinder body moves between the proximal position and the distal position.

6. The derrick assembly of claim 5, wherein the slide block includes a circular central opening sized and shaped to closely receive the cylinder body.

7. The derrick assembly of claim 5, wherein the slide block is formed of an ultra-high molecular weight plastic material.

8. The derrick assembly of claim 5, wherein the slide block is seated in a distal end portion of the channel.

9. A mobile drilling rig including the derrick assembly of claim 1, further comprising:

a vehicle to which the derrick assembly is mounted for movement between a first orientation and a second orientation; and a lifting assembly mounted to the vehicle and operable to move the derrick assembly between the first orientation and the second orientation.

10. The mobile drilling rig of claim 9, wherein the vehicle is a flatbed truck or a tracked vehicle.

11. The derrick assembly of claim 1, wherein the single-stage hydraulic cylinder assembly includes a hydraulic line extending along an outer surface of the single-tube cylinder body.

12. The derrick assembly of claim 1, wherein the drive assembly is coupled to a sidewall of the single-tube cylinder body.

13. A derrick assembly, comprising:

a frame;

a hydraulic cylinder assembly mounted to the frame, the hydraulic cylinder assembly comprising:

a piston rod secured to the frame;

a single-tube cylinder body mounted to the piston rod for reciprocal movement between a proximal position and a distal position; and a hydraulic chamber defined at least in part by the piston rod and the single-tube cylinder body, the hydraulic chamber having disposed therein a hydraulic fluid, the hydraulic chamber expanding and contracting with movement of the cylinder body between the proximal position and the distalposition;

wherein the hydraulic cylinder assembly is a single-stage hydraulic cylinder assembly;

a drive assembly mounted to the cylinder body for movement with the cylinder body between the proximal position and the distal position, wherein the drive assembly is operable to rotate an output shaft; and a hydraulic assembly configured to charge the hydraulic fluid into and out of the hydraulic chamber to cause the hydraulic chamber to expand and contract, thereby moving the cylinder body and the drive assembly between the proximal position and the distal position; and wherein the frame comprises an elongated channel in which the cylinder body is reciprocably mounted for movement between the proximal position and the distal position, wherein the channel has mounted therein a slide block along which the cylinder body slides as the cylinder body moves between the proximal position and the distal position, wherein the slide block includes a circular central opening sized and shaped to closely receive the cylinder body, and wherein the slide block further comprises a slot sized and shaped to receive a feed line of the hydraulic assembly.

14. The derrick assembly of claim 13, wherein a distal end portion of the single-tube cylinder body includes a hydraulic port in fluid communication with the single-stage hydraulic cylinder assembly.

15. A derrick assembly, comprising:

a frame comprising an elongated channel;

a hydraulic cylinder assembly mounted to the frame, the hydraulic cylinder assembly comprising:

a fixed part secured to the frame, wherein the fixed part comprises a piston rod;

a movable part mounted to the fixed part for reciprocal movement between a proximal position and a distal position, wherein the movable part comprises a cylinder body movably mounted to the piston rod; and a hydraulic chamber defined at least in part by the fixed part and the movable part, the hydraulic chamber having disposed therein a hydraulic fluid, the hydraulic chamber expanding and contracting with movement of the movable part between the proximal position and the distal position; and wherein the piston rod has mounted on a distal end thereof an internal seal cap partially defining the hydraulic chamber, wherein a distal end of the cylinder body has mounted thereon a distal end cap partially defining the hydraulic chamber, wherein the cylinder body further comprises a distal inlet positioned between the internal seal cap and the end cap, and wherein the hydraulic cylinder assembly further comprises a first pressure line terminating at the distal inlet;

a drive assembly mounted to the movable part for movement with the movable part between the proximal position and the distal position, wherein the drive assembly is operable to rotate an output shaft;

a hydraulic assembly configured to charge the hydraulic fluid into and out of the hydraulic chamber to cause the hydraulic chamber to expand and contract, thereby moving the movable part and the drive assembly between the proximal position and the distal position; and a slide block mounted in the channel, the slide block including an opening sized and shaped to receive the movable part as the movable part moves between the proximal position and the distal position;

wherein the frame remains stationary during expansion and contraction of the hydraulic chamber.

16. The derrick assembly of claim 15, wherein a cross-section of the opening corresponds to a cross-section of the movable part such that the opening is sized and shaped to closely receive the movable part.

17. The derrick assembly of claim 15, wherein the slide block is mounted in a distal end portion of the channel.

18. The derrick assembly of claim 15, wherein the slide block is formed of an ultra-high molecular weight plastic material.

19. The derrick assembly of claim 15, wherein the movable part comprises a single tube, and does not include an additional tube mounted inside or outside the single tube.

20. The derrick assembly of claim 15, further comprising:

a proximal end cap mounted to a proximal end of the cylinder body, wherein the piston rod extends through the proximal end cap; and a second hydraulic chamber defined between the proximal end cap and the internal seal cap;

wherein the hydraulic assembly is operable to move the cylinder body toward the distal position by charging hydraulic fluid into the hydraulic chamber and discharging hydraulic fluid from the second hydraulic chamber; and wherein the hydraulic assembly is operable to move the cylinder body toward the proximal position by discharging hydraulic fluid from the hydraulic chamber and charging hydraulic fluid into the second hydraulic chamber.

21. A derrick assembly, comprising:

a frame comprising an elongated channel;

a hydraulic cylinder assembly mounted to the frame, the hydraulic cylinder assembly comprising:

a fixed part secured to the frame;

a movable part mounted to the fixed part for reciprocal movement between a proximal position and a distal position; and a hydraulic chamber defined at least in part by the fixed part and the movable part, the hydraulic chamber having disposed therein a hydraulic fluid, the hydraulic chamber expanding and contracting with movement of the movable part between the proximal position and the distal position;

a drive assembly mounted to the movable part for movement with the movable part between the proximal position and the distal position, wherein the drive assembly is operable to rotate an output shaft;

a hydraulic assembly configured to charge the hydraulic fluid into and out of the hydraulic chamber to cause the hydraulic chamber to expand and contract, thereby moving the movable part and the drive assembly between the proximal position and the distal position;

a slide block mounted in the channel, the slide block including an opening sized and shaped to receive the movable part as the movable part moves between the proximal position and the distal position; and a mounting assembly mounted to the movable part;

wherein the drive assembly is mounted to the mounting assembly; and wherein the mounting assembly includes a guide plate that interfaces with the channel to facilitate movement of the movable part within the channel.

22. The derrick assembly of claim 21, wherein the fixed part comprises a piston rod, and wherein the movable part comprises a cylinder body movably mounted to the piston rod.

23. The derrick assembly of claim 22, wherein the piston rod has mounted on a distal end thereof an internal seal cap partially defining the hydraulic chamber;

wherein a distal end of the cylinder body has mounted thereon a distal end cap partially defining the hydraulic chamber;

wherein the cylinder body further comprises a distal inlet positioned between the internal seal cap and the end cap; and wherein the hydraulic assembly includes a first pressure line terminating at the distal inlet.

* * * * *